United States Patent [19]

Ichikawa et al.

[11] Patent Number: 4,647,927

[45] Date of Patent: Mar. 3, 1987

[54] DISPLAY DEVICE

[75] Inventors: Osamu Ichikawa, Tokyo; Tetsuo Sadamasa, Kawasaki, both of Japan

[73] Assignee: Tokyo Shibaura Denki Kabushiki Kaisha, Kawasaki, Japan

[21] Appl. No.: 808,376

[22] Filed: Dec. 16, 1985

Related U.S. Application Data

[63] Continuation of Ser. No. 462,771, Feb. 1, 1983, abandoned.

[30] Foreign Application Priority Data

Feb. 10, 1982 [JP] Japan ..... 57-20113

[51] Int. Cl.[4] ..... G09G 3/00

[52] U.S. Cl. ..... 340/801; 340/792

[58] Field of Search ..... 340/760, 762, 792, 793, 340/800, 801

[56] References Cited

U.S. PATENT DOCUMENTS

| | | | |
|---|---|---|---|
| 3,432,846 | 3/1969 | Jones et al. | 340/760 |
| 3,445,827 | 5/1969 | Keyes | 340/760 |
| 3,793,629 | 2/1974 | Sharpless | 340/762 |
| 3,909,788 | 9/1975 | Kaelin et al. . | |
| 4,121,256 | 10/1978 | Lorteije | 340/801 |
| 4,149,151 | 7/1979 | Nagae et al. | 340/801 |
| 4,180,813 | 12/1979 | Yoneda | 340/800 |
| 4,368,467 | 1/1983 | Unotoro et al. | 340/800 |
| 4,393,379 | 7/1983 | Berting et al. | 340/800 |

OTHER PUBLICATIONS

Proceedings of the S.I.D., vol. 21, no. 2, 1980, pp. 143–155, Los Angeles, US; K. T. Burnette: "Multi-Mode Matrix (MMM) Modular Flight Display Development".

Nachrichtentechnische Zeitschrift Ntz, vol. 33, no. 4, Apr. 1980, pp. 230–236, Berlin, DE; A. Fischer: "Flache Fernseh-Bildschirme".

*Primary Examiner*—Marshall M. Curtis

*Attorney, Agent, or Firm*—Oblon, Fisher, Spivak, McClelland, & Maier

[57] ABSTRACT

A display device having a display array of m×n display elements driven by a static shift register having m×n stages respectively corresponding to row and column designations of the display elements. The column lines of the display element array are driven by a first output of the m stages. At the same time, pixel data are supplied to the shift register in accordance with a binary level of an externally supplied select signal. Alternatively, the shift register is shifted in a recursive manner. The row lines of the display element array are scanned in accordance with a count of a clock signal. Select signal lines and clock signal lines are respectively aligned along the row and column directions of a unit panel when plural display arrays as described above are arranged in a matrix form to provide a large-screen display unit. The lines of each display array are sequentially driven in accordance with the supply pattern of the select and clock signals from a corresponding unit driver. The shift register arrangement decreases the number of connections or wirings between a module driver and the display element array and simplifies the circuit arrangement of the module driver.

5 Claims, 55 Drawing Figures

DISPLAY DEVICE

This application is a continuation of application Ser. No. 462,771, filed Feb. 1, 1983, now abandoned.

BACKGROUND OF THE INVENTION

The present invention relates to a display device having a display element array obtained by aligning display elements such as light-emitting diodes in a matrix and, more particularly, to a display device in which a module driver for driving the display element array can be easily mounted since its circuit arrangement is simplified, thereby achieving low power consumption and high integration of the circuit.

Conventionally, there are two drive methods for a display device having a display element array obtained by arranging display elements such as light-emitting diodes (LED) so as to display an alphanumeric pattern, a kanji pattern, a special symbol pattern, a graphic pattern or the like:

(1) A dynamic scanning method in which each display element is sequentially scanned in the same manner as in TV scanning; and (2) A static scanning method in which a memory element is arranged for each display element, and each display element arranged at an intersection between a row line and a column line is independently driven by an electrical signal from the memory element.

In the dynamic scanning method, particularly when LEDs are used as display elements and the number thereof is increased, the ON time of each element is shortened. This is because the response speed of the display elements is very fast. As a result, the dynamic scanning method has a disadvantage in that the display luminance is degraded under the condition of the same current. The static scanning method also has a disadvantage in that the matrix wiring for arranging the memory elements in a matrix form is complicated.

In order to eliminate drawbacks of both the dynamic and static scanning methods of the display matrix array and to utilize the advantages thereof, the line sequential scanning method as a composite method of the static and dynamic methods can be effectively used. According to the line sequential scanning method, a drive signal applied to a row line of the display element array is processed by time division and is used to sequentially scan the row lines. At the same time, pixel data supplied to the column lines is selectively switched in synchronism with the time division.

According to the line sequential scanning method, however, when a screen size is increased, it is difficult to scan display devices at a frequency which does not cause flickering because of the number of scanning and the time for scanning. Such a drawback occurs in display devices such as a multicolor LED display device (64×64 pixel matrix) described in "Denshi Zairyo" (Electronic Material), PP 68–72, February 1980, TV scanning matrix display devices (96×64 pixel matrix, and 160×112 pixel matrix) described in "IEEE Transaction on Electron Devices", PP 1182–1186, Vol. Ed. 26, No. 68, August 1979. In the multicolor display device (64×64 pixels), for example, the number of pixel data is 128, and the number of scanning lines is 64. Assume that pixel data is written in each memory in units of 8 bits. Sixteen writing operations must then be performed. Therefore, 1024 (16×64) writing operations must be performed for one frame. A repeat frequency must be more than 100 Hz to avoid flickering. The scanning frequency must be more than 102.4 kHz (1024×100). In a device such as a microprocessor to which a display device of this type is coupled, a data transfer speed is about 100 kHz, which corresponds to the maximum number of pixels used in the line sequential scanning method. An instantaneous current flowing through the display element array is determined by the number of pixel data supplied to the column lines. A surge current then flows through the row lines. As a result, a flat display device of this type cannot be made compact and cannot be directly coupled to an integrated circuit which does not allow flow of a surge current therethrough. Furthermore, the luminance of the display image is degraded.

In order to provide a display device which has a large number of pixels, that is, a large screen, a flat panel display is proposed in "Conference Record of 1978 Biennial Display Research Conference" October 24 to 26, SID PP 20 to 21, 1978. More particularly, unit display devices each having a drive circuit on the lower surface of the substrate are coupled to each other. The drive circuit of the unit display device has memory elements which respectively correspond to pixels of the display element array, so that each display element array can be individually driven. As a result, the flat panel display is very suitable for the response characteristics of LEDs and can be readily arranged together with an IC.

This display device is schematically shown in FIG. 1. A unit display device 3 comprises an LED array 1 and a module driver 2, which latter is integral with the LED array 1 and provides a display function by itself. The LED array is a display section in which a plurality of LEDs of a matrix array constitute predetermined pixels on a substrate in a monolithic or hybrid structure. The module driver 2 is a drive circuit for driving the LED array 1 in accordance with the line sequential scanning method. As shown in FIG. 2, the unit display devices 3 are arranged in a matrix form to constitute a unit panel 4 which has a desired size. The unit panel 4 receives various signals and a power source voltage from a unit driver 5. The unit panel 4 and the unit driver 5 thus constitute a display unit 6 which has an overall display function.

The present inventors have proposed a detailed arrangement of the module driver of the unit display in Japanese Patent Application No. 55-78940. In principle, serial pixel data supplied to the module driver is converted to parallel data which is then stored in a static RAM in response to an address signal from the unit driver. In synchronism with data read out from the static RAM, the row lines of the LED array are scanned. Now assume that the number of elements in the row direction is m, and that the number of elements in the column direction is n. The static RAM has m×n bits (e.g., 16×16 bits). The construction of the display device is complicated when both row and column address registers are considered for accessing the RAM, thus preventing a compact module driver.

Furthermore, in the arrangement described above, the unit driver must supply various signals to each module driver. These various signals include pixel data, a clock signal, a reset signal, a parallel multibit address signal, and a select signal for selecting the read and write operations of the RAM, that is, the data storage and retrieval (display) operations. For this reason, if up to several tens of unit display devices are connected to each other, the above-mentioned arrangement is effective. However, in the case of a large screen of 30 (column direction)×30 (row direction) unit displays, the unit driver must be arranged on a large scale since the number of bits of the address signal is increased. As a result, complex wiring must be performed between the unit driver and the unit display devices, thus resulting in inconvenience in practice.

SUMMARY OF THE INVENTION

It is an object of the present invention to provide a display device in which a module driver for driving a display element array such as an LED array of a predetermined number of pixels has a simple circuit configuration, so that the module driver is easily mounted therein so as to achieve low power consumption and an IC display device.

It is another object of the present invention to provide a display device which allows a decrease in the number of wirings connected between each unit display and a unit driver when a large-screen display unit is arranged by combining a great number of unit display devices each having a predetermined number of pixels.

It is still another object of the present invention to provide a display device in which the unit driver has a simple circuit configuration when a large-screen display unit is arranged by combining a large number of unit display devices each having a predetermined number of pixels.

In the display device according to the present invention, when m row element and n column elements constitute a display element matrix as a memory for storing serial pixel data, an m×n static shift register is used. The column lines of the display element array are driven by a first output of the m stages. At the same time, the pixel data is supplied to the shift register in accordance with a binary level of an externally supplied select signal. Alternatively, the shift register is shifted in a recursive manner. The row lines of the display element array can be scanned in accordance with a count of a clock signal.

Furthermore, select signal lines and clock signal lines are respectively aligned along the row and column directions of a unit panel when the display devices described above are respectively used as unit display devices which are then arranged in a matrix form and when a large-screen display unit is arranged as the unit panel. The lines of each unit display are sequentially driven in accordance with the supply pattern of the select and clock signals from the corresponding unit driver.

According to the present invention, the circuit arrangement of the module driver in the unit display device can be simplified. This is because the memory for storing pixel data supplied to the display element array comprises the shift register, and because the read/write operation of the pixel signal can be performed only by input switching and a shifting of the shift register in response to the clock signal. Therefore, the module driver has low power consumption. Furthermore, the module driver is mounted on the lower surface of the substrate of the display element array and can be readily arranged in an IC.

Furthermore, according to the present invention, in the case of obtaining a large-screen unit panel by arranging the unit display devices in a matrix form, the unit display devices can be easily controlled by a combination of the select and clock signals. Therefore, the number of wirings respectively connecting the unit display devices and the unit driver can be greatly decreased. The arrangement of the unit driver is further simplified. As a result, an ultra-large screen which has several hundred of unit display devices can be easily formed.

BRIEF DESCRIPTION OF THE DRAWINGS

By way of example and to make the description clearer, reference is made to the accompanying drawing, in which.

DETAILED DESCRIPTION OF THE PREFERRED EMBODIMENTS

Figure 3:
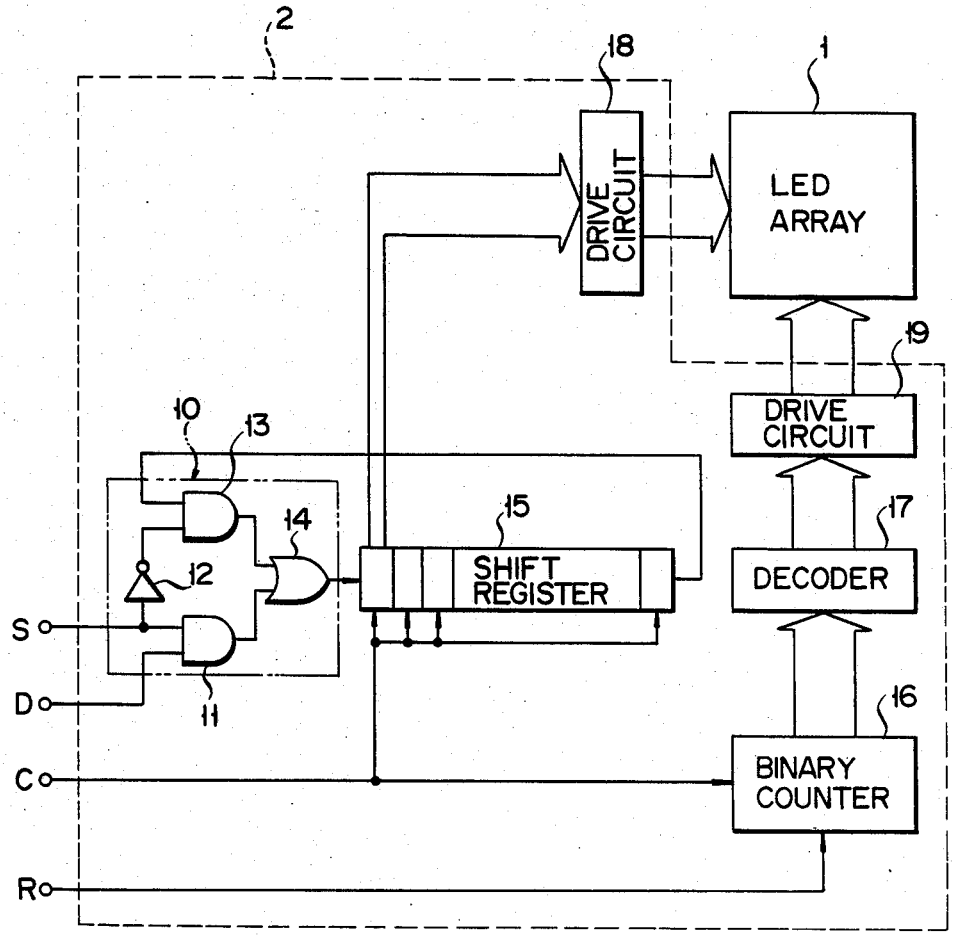
FIG. 3 is a block diagram schematically showing the overall arrangement of a display device according to a first embodiment of the present invention.

FIG. 3 shows the arrangement of a unit display device according to a first embodiment of the present invention. Referring to FIG. 3, an LED array 1 as the display element array has a structure in which m row LEDs and n column LEDs are aligned in a matrix form. The LEDs are connected at intersections between m row lines $L_{11}$ to $L_{1m}$ and n column lines $L_{21}$ to $L_{2n}$, respectively, where m and n may be respectively 16 but are not limited to these numbers. The LED array 1 is formed on a single chip substrate. A module driver 2 is formed on the lower surface of the substrate to drive the LED array 1. The module driver 2 is arranged and operated in a manner to be described below.

The module driver 2 receives a select signal S, serial pixel data D, a clock signal C and a reset signal R. Among these signals, the select signal S and the serial pixel data D are supplied to a switching circuit 10 which comprises an AND gate 11, an inverter 12, an AND gate 13 and an OR gate 14. The switching circuit 10 is operated to supply the pixel data D to the first stage of a shift register 15 when the select signal S is set at logic level "1" (first logic level). However, when the select signal S goes low (second logic level), the switching circuit 10 is operated to transmit the pixel data D at the end stage to the first stage of the shift register 15.

Figure 4:
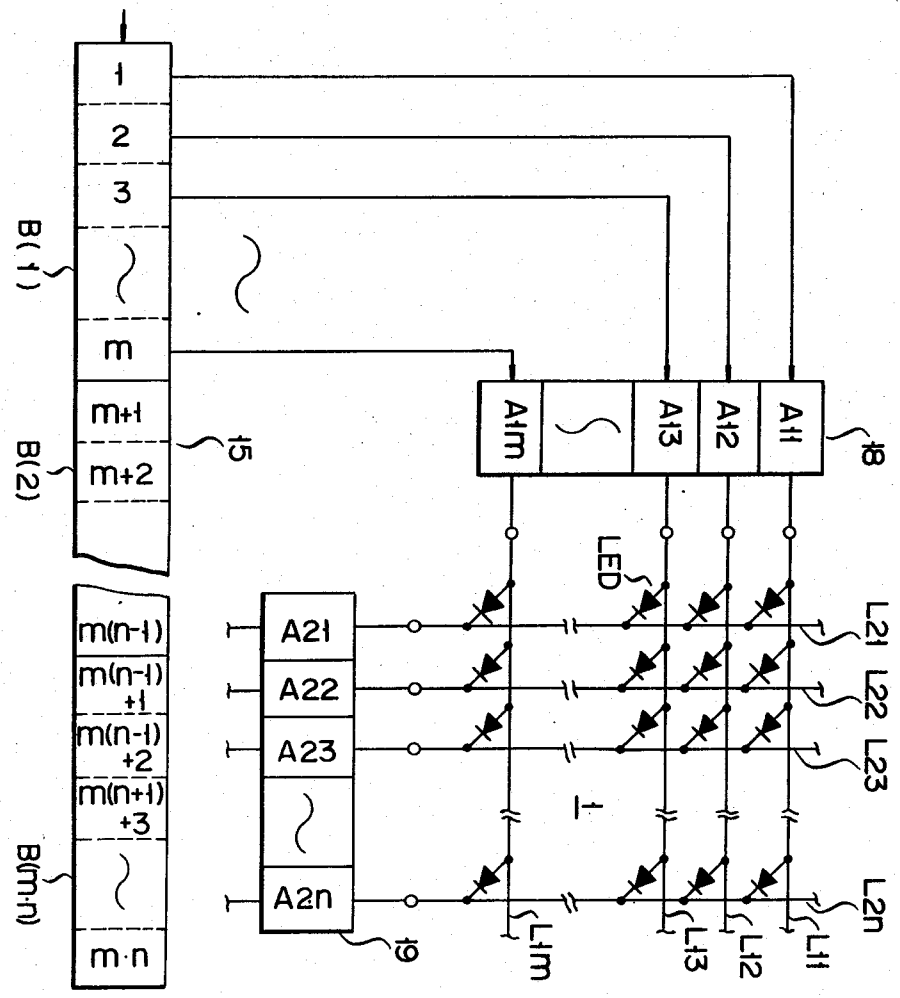
FIG. 4 is a circuit diagram schematically showing an LED array 1 (FIG. 3) and its related circuits.

As shown in FIG. 4, the shift register 15 comprises an n×m static shift register. In other words, m stages are regarded as one block, so that the shift register 15 has n blocks B(1) to B(n). An output from the first block B(1) (i.e., the first to mth stages) of the shift register 15 is supplied to the row lines $L_{11}$ to $L_{1m}$ of the LED array 1 through a first drive circuit 18 which comprises m amplifiers $A_{11}$ to $A_{1m}$. It is noted that in FIG. 4 the vertical direction corresponds to the column direction and the horizontal direction corresponds to the row direction.

The clock signal C is supplied to a binary counter 16 as well as to the shift register 15. The binary counter 16 counts the clock signal C after it is reset to an initial status (logic level of "0") in response to the reset signal R. An output from the counter 16 is supplied to a decoder 17. The decoder 17 has n output ends. When the condition m=16 is given, the decoder 17 produces scanning signals from its output ends to scan the column lines $L_{21}$ to $L_{2n}$ of the LED array 1 every time the counter 16 counts 16 clock signals C. These scanning signals are respectively supplied to the column lines $L_{21}$ to $L_{2n}$ through a second drive circuit 19 which comprises n current amplifiers.

In the first embodiment, the serial pixel data D of m×n bits which corresponds to one frame of the LED array 1 is supplied to the first stage of the shift register 15 through the switching circuit 10 when the select signal is set at logic level "1". The serial pixel data D is sequentially supplied in synchronism with the clock signal C. Thereafter, when the select signal S is set at logic level "0", the pixel data D is no longer supplied to the shift register 15. Instead, a feedback path is formed, so that the pixel data D is fed back from the end stage to the first stage of the shift register 15. The pixel data of m×n bits which is stored in the shift register 15 is shifted and circulated in the shift register 15. In this pixel data in the shift register 15, only 16-bit data in the first block B(1) is produced as a drive signal to drive the row lines $L_{11}$ to $L_{1m}$ of the LED array 1 through the first drive circuit 18. Every time the pixel data D in the shift register 15 is shifted by m stages, the column lines $L_{21}$ to $L_{2n}$ of the LED array 1 are sequentially scanned by the counter 16, the decoder 17, and the second drive circuit 19. As a result, the pixel data in the shift register 15 is then displayed as one frame on the screen.

In the display mode described above, the pixel data of one row in the first block B(1) of the shift register 15 is sequentially shifted by one bit to the subsequent stages, and then the next pixel data of one row is then shifted. It is not desirable that the shift of the pixel data in the shift register 15 is displayed on the screen of the LED array 1. This can be prevented when the column lines $L_{21}$ to $L_{2n}$ are not switched during the OFF time which corresponds to 10 to 100 times the period of the clock signal C and which is arranged between the k.mth clock pulse C and the k(m+1)th clock signal C (k=1, 2, . . . ).

Figure 1:
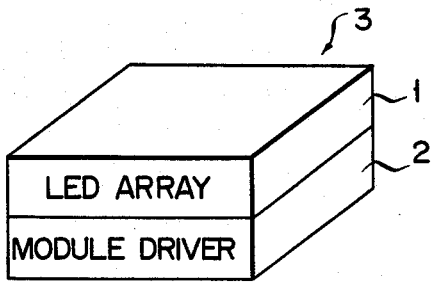
FIG. 1 (PRIOR ART)
FIG. 1 is a schematic view of a unit display device.
Figure 2:
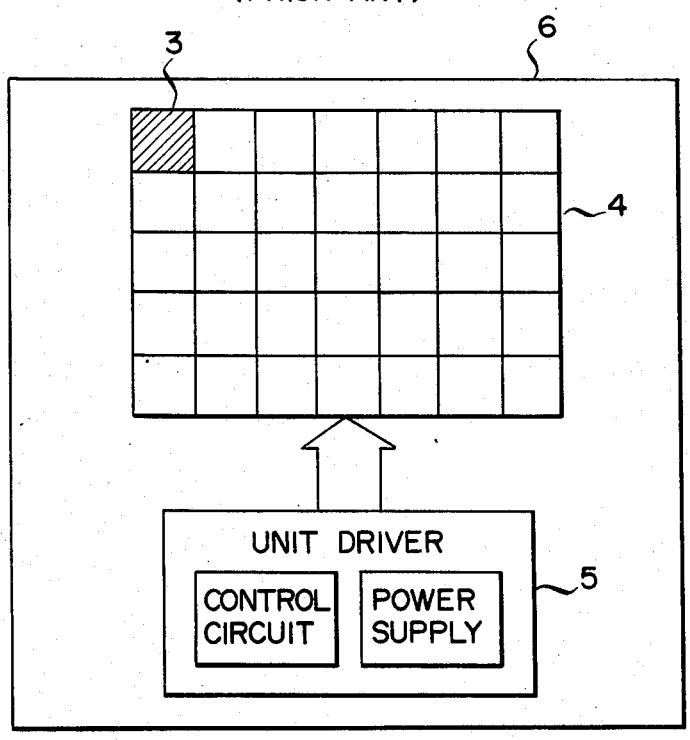
FIG. 2 (PRIOR ART)
FIG. 2 is a schematic view of a display unit in which unit display devices shown in FIG. 1 are aligned in a matrix form.
Figure 5:
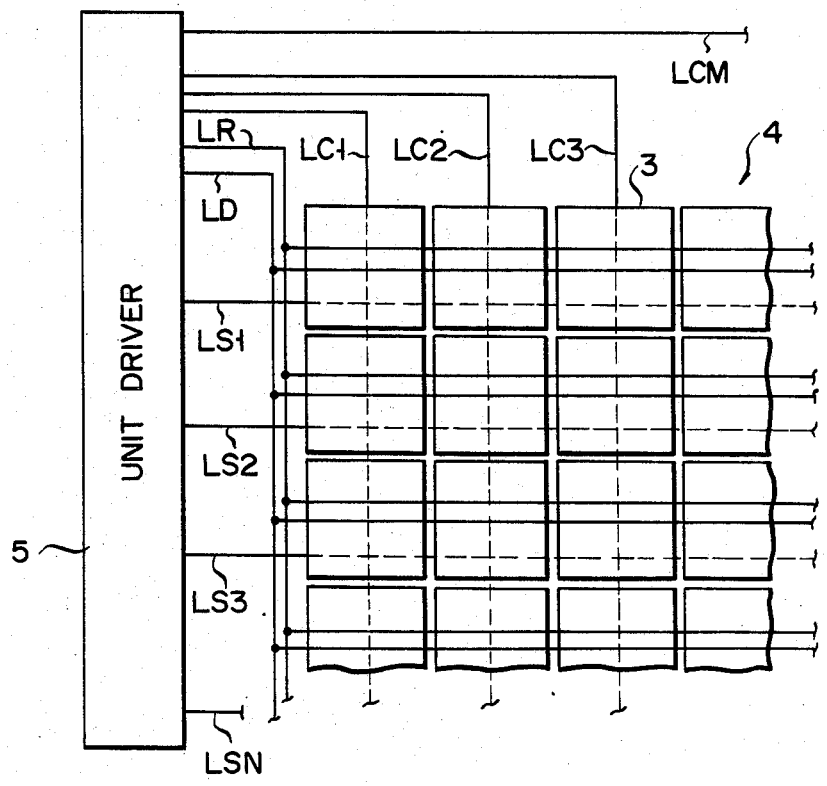
FIG. 5 is a schematic view of a display unit in which the unit display devices shown in FIG. 3 are aligned in a matrix form.
Figure 6:
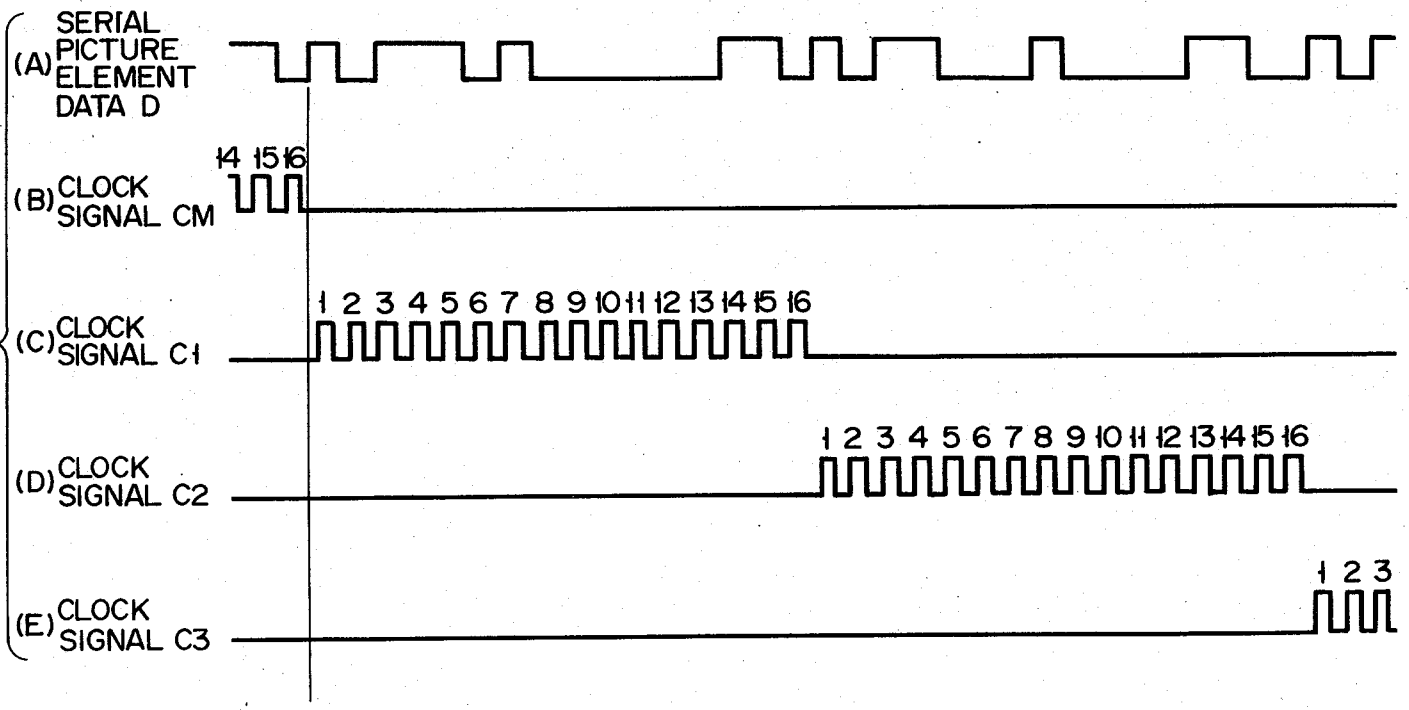
FIGS. 6A, 6B, 6C, 6D and 6E and FIGS. 7A, 7B, 7C, 7D, 7E, 7F and 7G are timing charts for explaining the operation of the display unit shown in FIG. 5.
Figure 7:
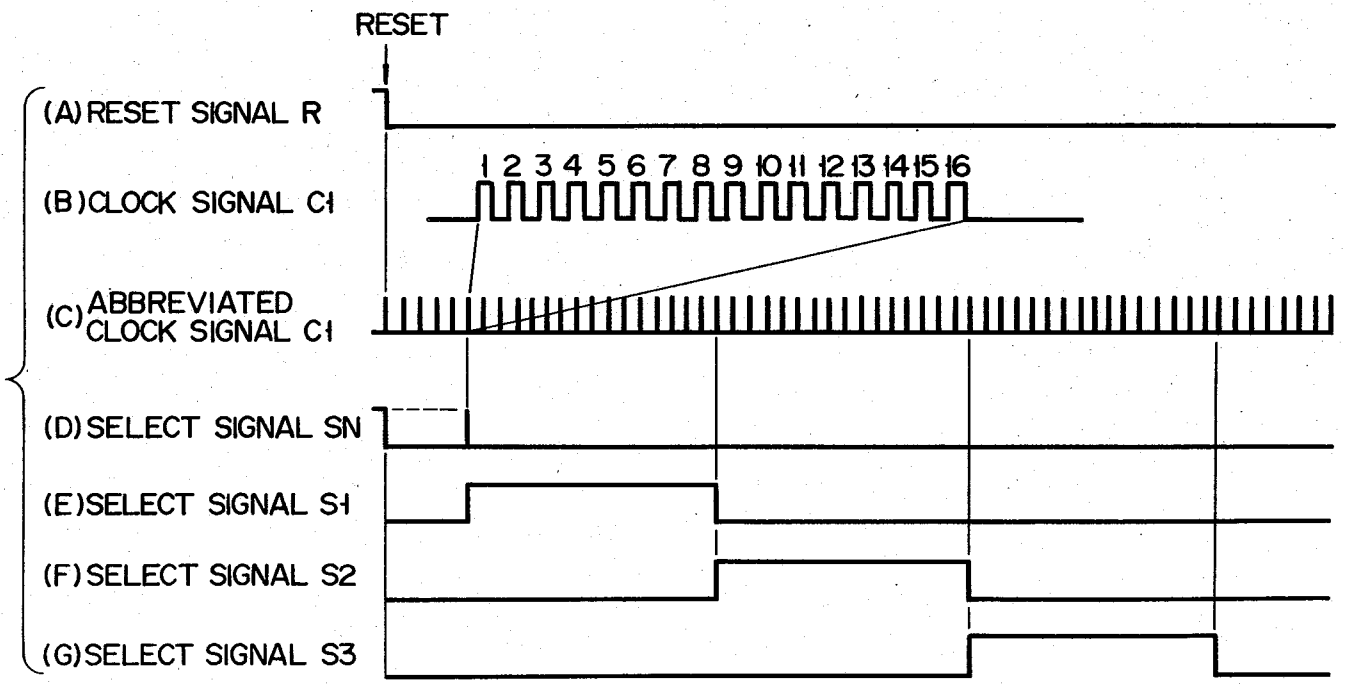

A case will be described with reference to FIG. 5 in which a large screen is arranged. Referring to FIG. 5, the unit panel 4 is arranged such that the unit display devices 3 shown in FIG. 3 are aligned on a printed circuit board in a matrix form. Assume that M unit display devices are aligned along the row direction and that N unit display devices 3 are aligned along the column direction, where the horizontal direction corresponds to the row direction and the vertical direction corresponds to the column direction. The display unit 6 is constituted by a combination of the unit panel 4 and the unit driver 5 in a manner as described with reference to FIG. 2. Various lines LD, LR, LC1 to LCM and LS1 to LSN are connected between the unit panel 4 and the unit driver 5. The pixel data line LD for supplying serial pixel data and the reset signal line LR are commonly connected to all the unit display devices 3. The clock signal lines LC1 to LCM are respectively connected to columns of unit display devices 3. The select signal lines LS1 to LSN are respectively connected to rows of the unit display devices 3. The total number of lines between the unit panel 4 and the unit driver 5 excluding a power source line (not shown) is (M+N+2) and is greatly decreased as compared with the device described in Japanese Patent Application No. 55-78940.

The mode of operation of the large-screen display device described above will be described with reference to FIGS. 6A to 6E and FIGS. 7A to 7G. FIGS. 6A to 6E show the relationships among the serial pixel data D supplied onto the pixel data line LD and the clock signals C1 to CM respectively supplied onto the clock signal lines LC1 to LCM. FIGS. 7A to 7G show the relationships among the reset signal R supplied onto the reset signal line LR, the clock signal C1 supplied onto the clock signal line LC1, and the select signals S1 to SN respectively supplied onto the select signal lines LS1 to LSN. Let m of the LED array 1 be 16.

After the reset signals R are supplied to all the unit display devices 3 from the unit driver 5, the select signal S1 is set at logic level "1", whereas the select signals S2, S3, . . . , and SN are set at logic level "0". The M unit display devices of the first row which receive the select signals S1 is kept in the ready state. The M unit display devices can then receive the pixel data D. The clock signals C1 to CM are sequentially supplied from the unit driver 5, where each clock signal comprises 16 pulses, so that the 16-bits of the pixel data D are sequentially supplied to the first blocks B(1) of the shift registers 15 of the M unit display devices 3 of the first row. As a result, the (m×n)-bit pixel data corresponding to one frame of the LED array 1 is stored in the shift registers 15 of the M unit display devices of the first row.

When the select signal S2 is set at logic level "1", whereas the select signals S1, S3, S4, . . . , SN are set at logic level "0", the clock signals C1 to CM are sequentially supplied from the unit driver 5, where each clock signal comprises 16 pulses, so that the 16-bits of the pixel data D are sequentially supplied to the first blocks B(1) of the shift registers 15 of the M unit display devices 3 of the second row. The (m×n)-bit pixel data corresponding to one frame of the LED array 1 is stored in the shift registers 15 of the M unit display devices of the second row. In this condition, since the select signal S1 is set at logic level "0", the pixel data in the shift registers 15 of the M unit display devices of the first row can be read out. Therefore, in synchronism with the clock signals C1 to CM for the second row, the pixel data of the first row can be displayed at the LED arrays.

The select signals S3, S4, . . . , and SN are sequentially set at logic level "1", and the same operation as described above is repeated. The pixel data are sequentially stored in the shift registers 15 of the M unit display devices of a given row, and at the same time, the pixel data in the devices of a row immediately before the given row are displayed at the LED arrays 1 of the unit display devices. As a result, the unit panel as a whole displays one picture.

Figure 8:
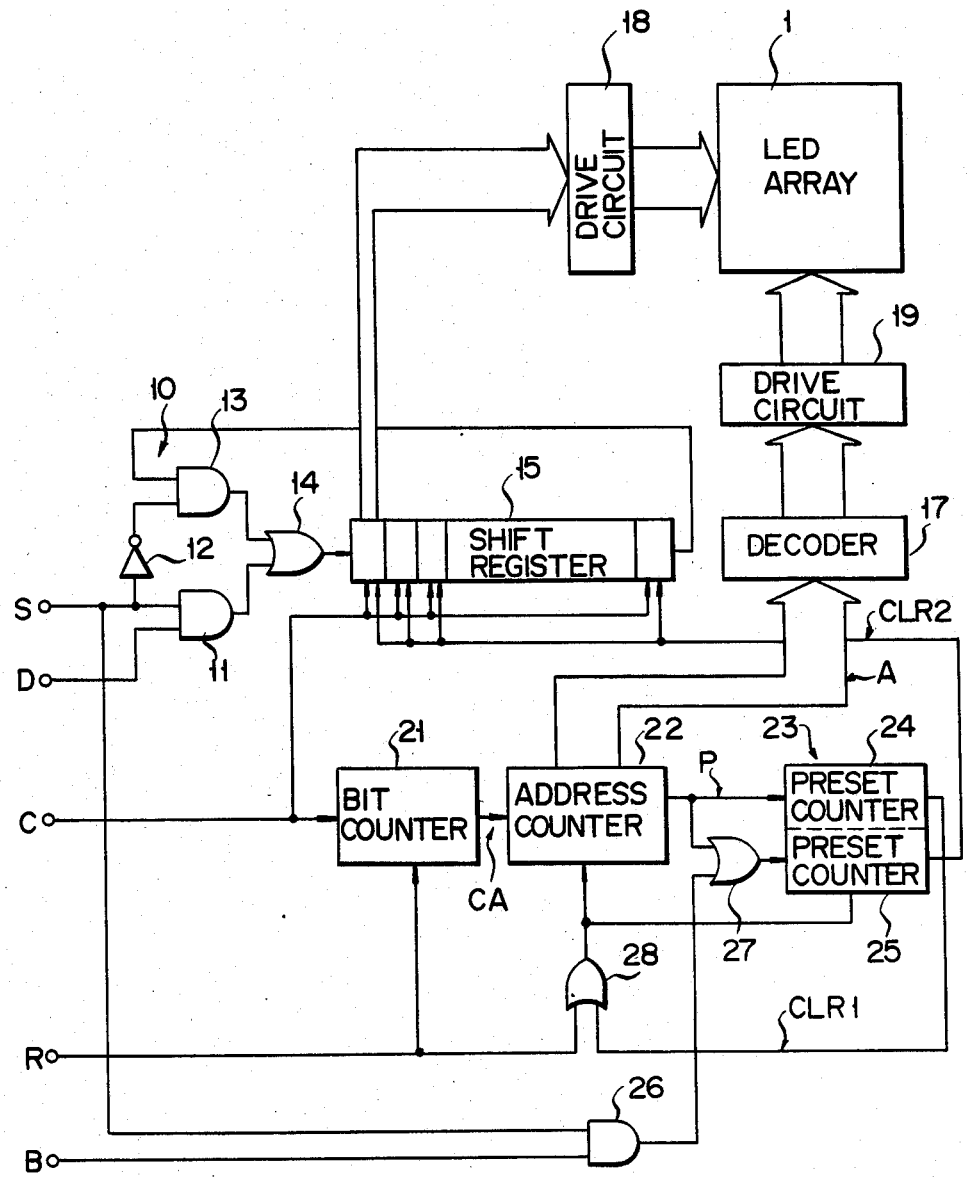
FIG. 8 is a block diagram schematically showing the overall arrangement of a display device according to a second embodiment of the present invention.

FIG. 8 is a block diagram of a display device according to a second embodiment of the present invention. The display device of this embodiment is arranged such that the luminance of the LED array 1 can be adjusted. The display device will be described with reference to FIG. 8 and FIGS. 9A to 9J (timing charts) so as to emphasize differences between the display devices of the first and second embodiments.

Referring to FIG. 8, a bit counter 21 and an address counter 22 are used in place of the binary counter 16 shown in FIG. 3. The bit counter 21 is reset to the initial state in response to the reset signal R and produces a carry signal CA every time it counts 16 pluses of the clock signal C shown in FIGS. 9A to 9D. The address counter 22 receives the carry signal CA and sequentially supplies an address signal A (FIG. 9B) to a decoder 17 so as to specify the row lines $L_{11}$ to $L_{1m}$.

Figure 9:
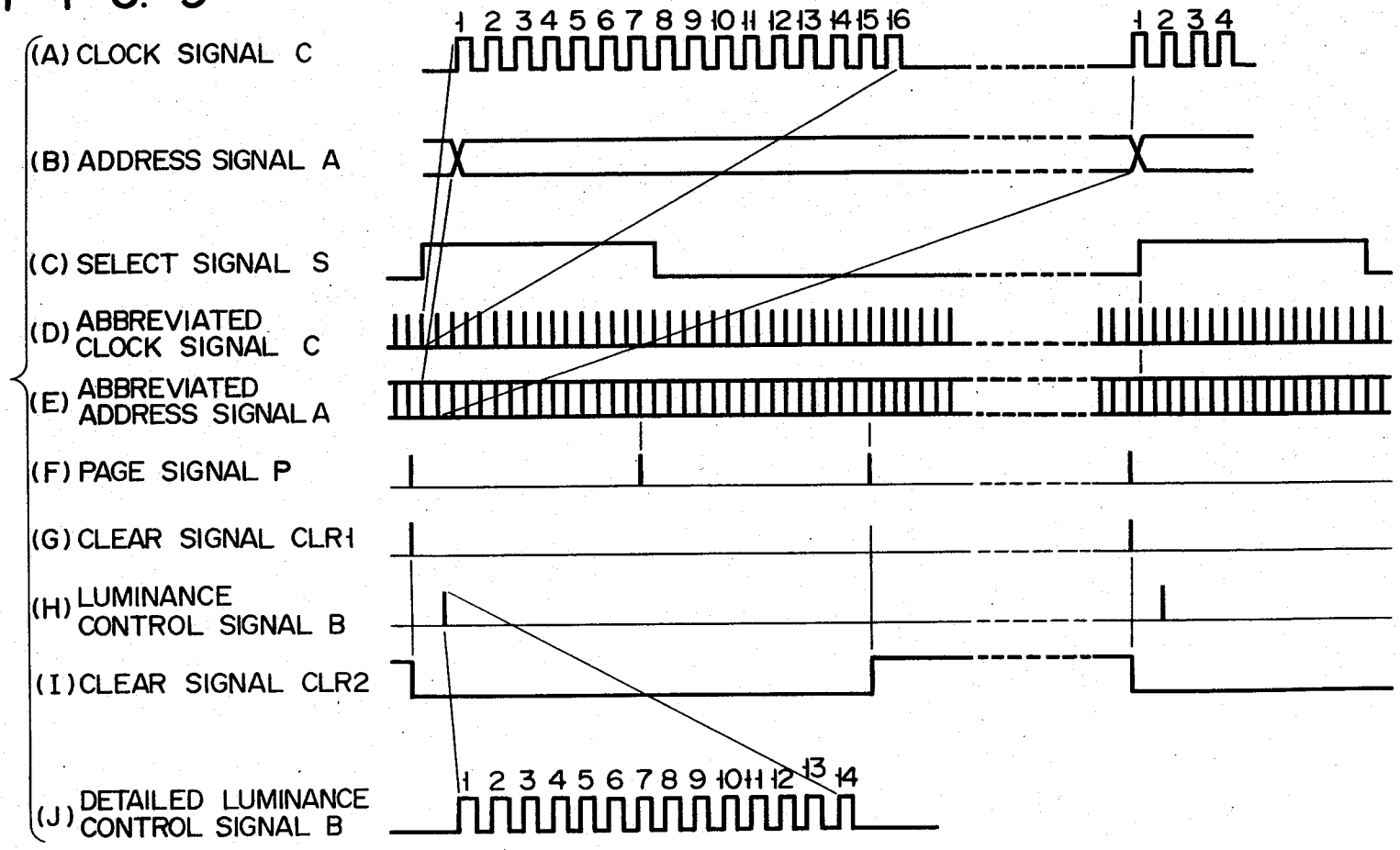
FIGS. 9A, 9B, 9C, 9D, 9E, 9F, 9G, 9H, 9I and 9J are timing charts for explaining the operation of the display device shown in FIG. 8.

The address counter 22 produces a page signal P (FIG. 9F) every time all the row lines $L_{11}$ to $L_{1m}$ are driven once by the address signal A. The page signal P is supplied directly to a first preset counter 24 of a page counter 23 and to a second preset counter 25 thereof through one input end of a 2-input OR gate 27. The other input end of the OR gate 27 receives an output from an AND gate 26 which receives the select signal S and a luminance control signal B (FIGS. 9H and 9J). The luminance control signal B is an input signal externally supplied (e.g., from the unit driver 5) in the second embodiment. The luminance control signal has the same pulse train as the clock signal C which is supplied in synchronism with the select signal S.

The preset counters 24 and 25 of the page counter 23 respectively produce clear signals CLR1 and CLR2 when their counts reach a preset value corresponding to the select signal lines LS1 to LSN, that is, the N column unit display devices 3, when the display device of this embodiment is used as the unit display device 3 shown in FIG. 5. The preset counters 24 and 25 may comprise up or down counters. If down counters are used as the preset counters 24 and 25, respectively, N is the initial value. When the counts reach zero, the preset counters 24 and 25 respectively produce the clear signals CLR1 and CLR2. The preset counter 24 is arranged to provide a more stable and synchronous operation of the module driver 2. When the preset counter 24 counts N page signals P, it produces the clear signal CLR1 shown in FIG. 9G so as to initialize the address counter 22 and the page counter 23 in the initial status through an OR gate 28 in the same manner as the reset signal R. The preset counter 25 is arranged for luminance control. The preset counter 25 counts, through the OR gate 27, the pulse number $N_B$ of the luminance control signal B supplied through the AND gate 26 when the select signal S is set at logic level "1", and the number of page signals P (the number of scannings of the row lines $L_{11}$ to $L_{1m}$, that is, the display page number). When the count of the preset counter 25 reaches N, it produces the clear signal CLR2 (FIG. 9J). All the contents of the shift register 15 are then cleared. It is noted that the pulse number $N_B$ is equal to or smaller than N, and that the same-picture display number (repeat page number) $N_P$ is expressed as $(N-N_B)$. The display luminance depends upon the number $N_P$ and is maximized for $N_B=0$. When the pulse number $N_B$ is changed, the luminance can be easily adjusted. For $N=16$, and $N_B=14$, the repeat page number $N_P$ is 2, and the luminance is 2/16 the maximum luminance.

Figure 10:
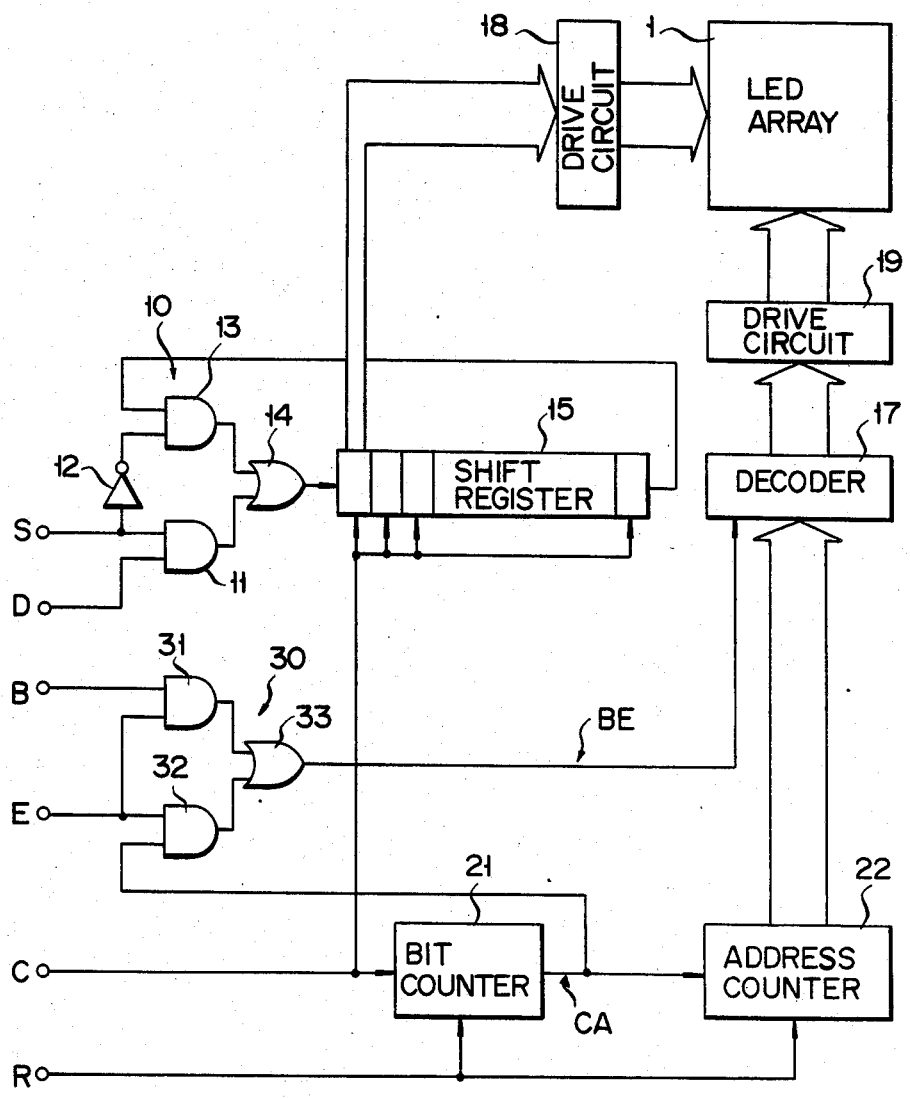
FIG. 10 is a block diagram schematically showing the overall arrangement of a display device according to a third embodiment of the present invention.

FIG. 10 is a block diagram of a display device according to a third embodiment of the present invention. The display device of the third embodiment is substantially the same as that of the second embodiment, except that a luminance control circuit 30 which comprises AND gates 31 and 32 and an OR gate 33 is used in place of the page counter 23 and the gates 26 to 28, and that an enable signal E is used to control the luminance control operation based on the luminance control signal B. In this case, a pulse is used which can be width-modulated during a time interval in a range of one to 15 periods every time 16 pulses of the clock signal C are produced.

Figure 11:
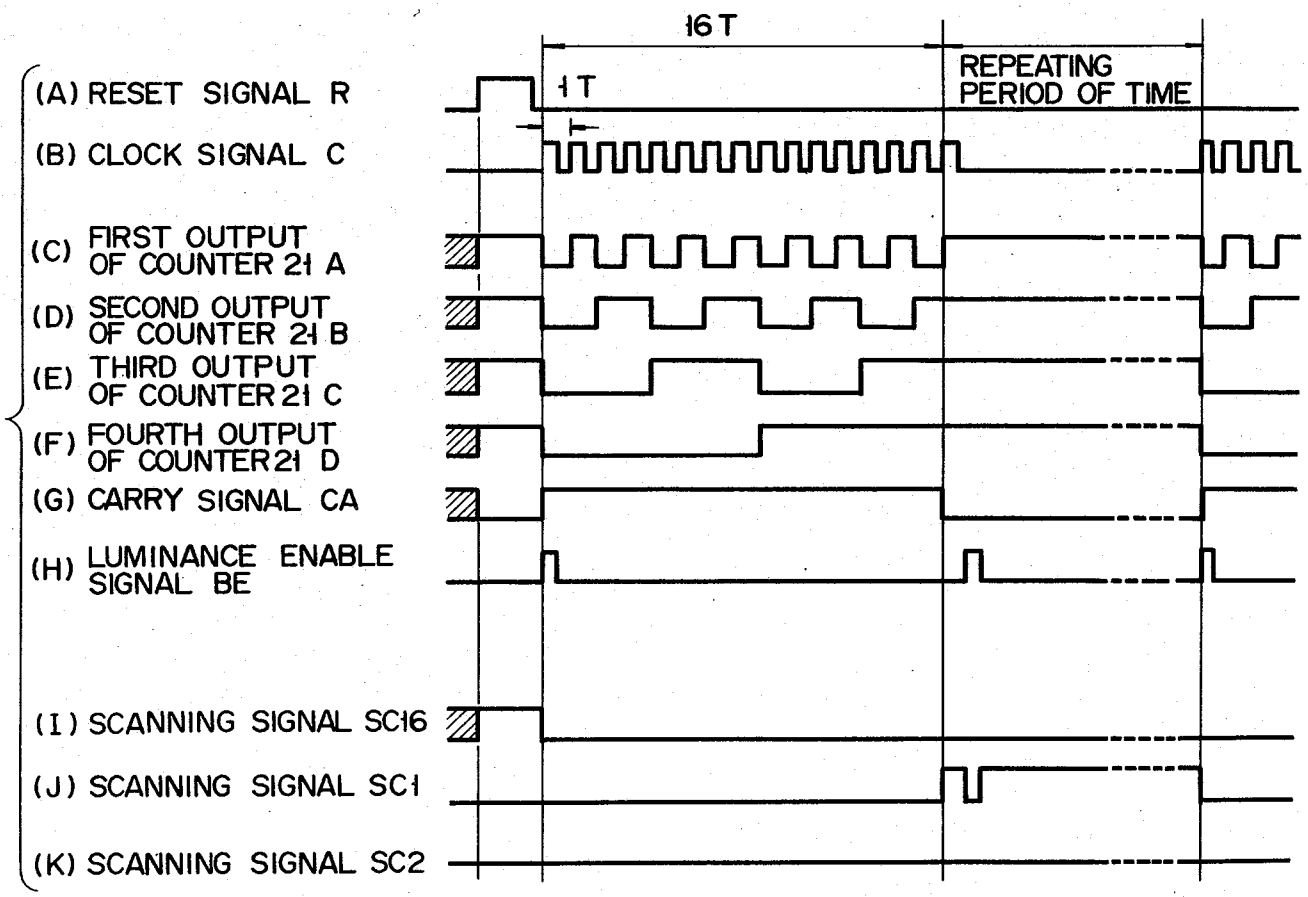
FIGS. 11A, 11B, 11C, 11D, 11E, 11F, 11G, 11H, 11I, 11J and 11K are timing charts for explaining the operation of the display device shown in FIG. 10.
Figure 12:
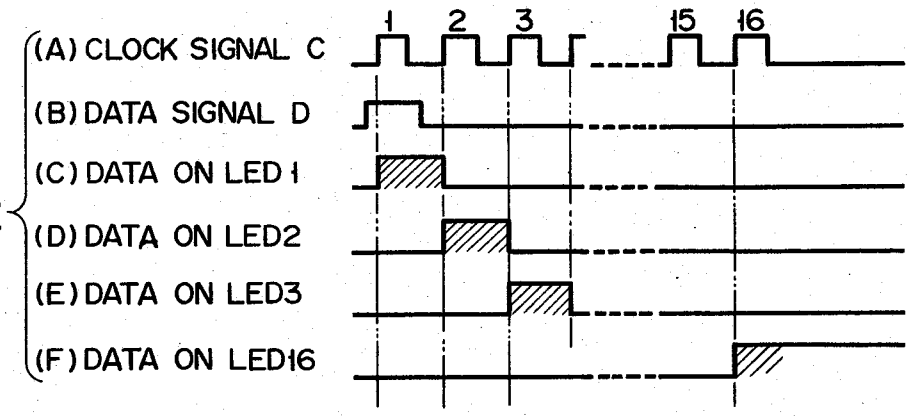
FIGS. 12A, 12B, 12C, 12D, 12E and 12F are timing charts for explaining the operation of the LED array 1 shown in FIG. 4.

The mode of operation of the display device according to the third embodiment of the present invention will be described with reference to the timing charts of FIGS. 11A to 11K. The luminance control signal B is supplied to the AND gate 31. As shown in FIGS. 11C to 11G, first, second, third and fourth outputs A, B, C and D from the bit counter 21 are kept high, a carry signal CA of low level is produced and is supplied to the AND gate 32 and the address counter 22. The lumiance control signal B and the carry signal CA pass through the AND gates 31 and 32 when the enable signal E is kept high and are mixed by the OR gate 33, so that a luminance enable signal BE is produced as shown in FIG. 11H. The luminance enable signal BE is supplied to a decoder 17. When the luminance enable signal BE goes high, the decoder 17 does not produce scanning signals SC1 to SCn. The scanning signals SC1, SC2 and SC16 are exemplified and respectively shown in FIGS. 11I, 11J and 11K. The LED array 1 is thus stopped. The OFF time corresponds to the pulse width of the luminance control signal B, thereby controlling the luminance of the display contents. When the enable signal E goes low, the luminance control signal B and the carry signal CA are not detected by the luminance control circuit 30. As a result, luminance control is not performed.

An application example of the present invention will be described hereinafter. The pixel data as the output of mth stages of the first block B(1) of the shift register 15 is amplified by the current amplifiers $A_{11}$ to $A_{1m}$ of the first drive circuit 18 and is supplied to m LEDs of one column of the LED array 1. For this reason, the output from the first block B(1) of the shift register 15 is transmitted through the LED array 1 until m-bit pixel data are prepared. When only the first bit of the pixel data of m bits for one row is set at the significant level, this 1-bit data is transmitted from the top to the bottom of a given column of the LED array by one pixel in synchronism with each pluse of the clock signal C. The hatched portions in FIGS. 12C to 12F indicate the ON periods of the LEDs. However, the operator naturally observes a still image even if the LEDs sequentially flash by setting the OFF time (until the next set of m clock pulses of the clock signal C is supplied) to be longer. The sequential flashing of the LEDs can be positively utilized. For example, a position detection apparatus with a light pen can be provided.

Figure 13:
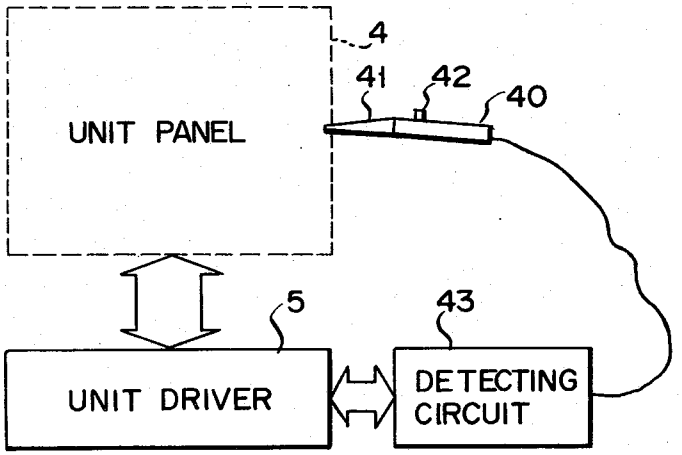
FIG. 13 is a block diagram schematically showing an application example of the present invention.

FIG. 13 shows a schematic arrangement of the position detection apparatus. A light pen 40 has a light-receiving element 41 and an operation switch 42, and is connected to a detecting circuit 43. The display content on a unit panel 4 is preferably a still image unless an external key operation is performed.

Figure 14:
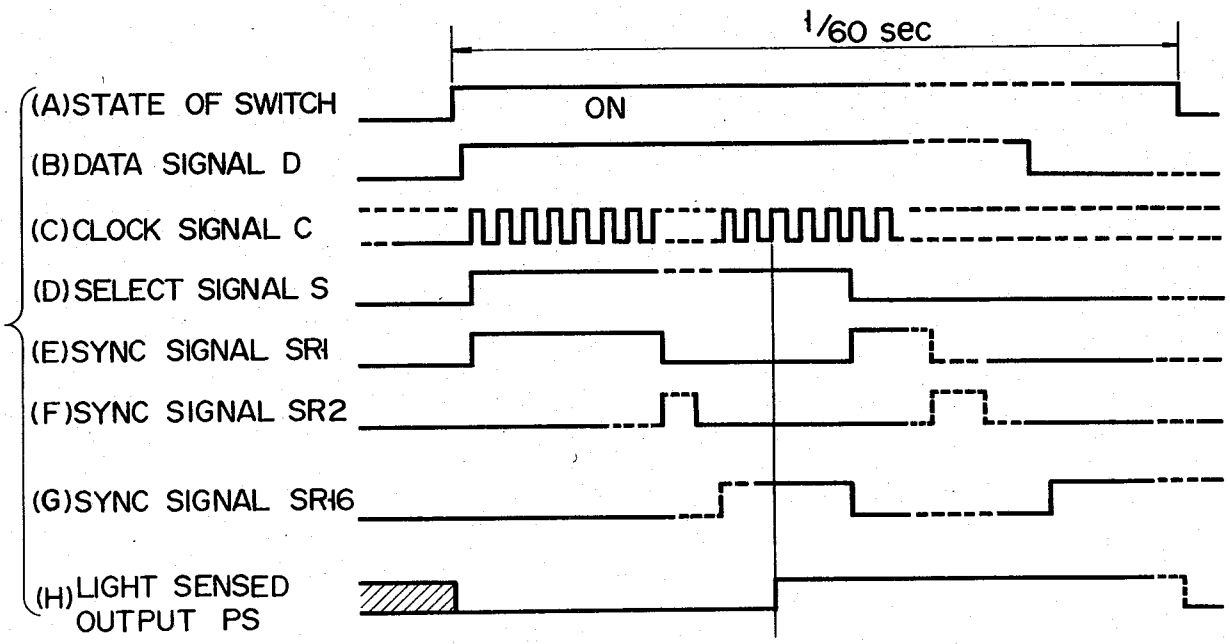
FIGS. 14A 14B, 14C, 14D, 14E, 14F, 14G and 14H are timing charts for explaining the operation of the application example shown in FIG. 13.

The timing charts of position detection are shown in FIGS. 14A to 14H. When the operator turns on the operation switch 42 of the light pen 40, as shown in FIG. 14A, pixel data input to the unit driver 5 is prohibited for 1/60 second. In this condition, the pixel data supplied to each unit display device of the unit panel 4 is the data which enables all the LEDs. Sync signals SR1 to SRM (only the sync signals SR1, SR2 and SR16 are exemplified as shown in FIGS. 14E to 14G) are respectively obtained by dividing the select signals S1 to SN by M (=16 in this case). The sync signals SR1 to SRM are supplied together with the select signal S (S1 to SN) shown in FIG. 14D and the clock signal C shown in FIG. 14C to the detecting circuit 43. The detecting circuit 43 then detects a light pen position on the unit panel 4, where the light pen position is a panel position with which the light pen 40 is brought into contact. This detection is performed in accordance with states of the select signals S1 to SN and the sync signals SR1 to SRM in synchronism with a light output PS from the light pen 40 through the light-receiving element 41, and the count of the clock signal C. When the light pen position on the unit panel 4 is detected, the light pen position in the unit display device is detected. Furthermore, a pixel is detected which corresponds to the light pen position along the row and column directions. As a result, the detecting circuit 43 produces a detection signal.

The present invention may also be applied to an LED display device having a multicolor display function. In this case, the serial pixel data for each color is prepared, and a corresponding switching circuit 10 and shift register 15 must be added for each color. The matrix structure of the display element array is not limited to a 16×16 matrix, but may be extended to 32×32, 16×32 matrices or the like. Furthermore, the display element is not limited to the LED.

Other changes and modifications may be made within the spirit and scope of the present invention.

What we claim is:

1. A display device comprising:

a display element array having first m drive lines, second n drive lines and m×n display elements arranged at intersections of said first m drive lines and said second n drive lines;

serial shift register means having a data input, a data output, and m×n stages for storing pixel binary data, said m×n stages divided into n blocks each having m stages, only a first block of said shift register means having m parallel outputs connected to said first m drive lines;

clock pulse signal supply means for supplying a clock pulse signal to said shift register means to shift pixel data through said shift register means, said clock pulse signal having intermittent pulse trains at intervals of a predetermined period, and each of said pulse trains having successive m clock pulses;

a serial pixel binary data source;

switch circuit means responsive to a select signal for selectively coupling one of said pixel data source and said data output of said shift register means to said data input of said shift register means;

first driving circuit means responsive to said m parallel outputs of said first block of said shift register means for driving said first m drive lines of said display element array; and second driving circuit means responsive to said clock pulse supply means for sequentially driving said second n drive lines of said display element array;

wherein said second driving circuit means comprises, counter means for counting said clock pulses in said clock pulse signal from said clock pulse signal supply means, and decoder means having n outputs coupled to said n drive lines of said display element array and responsive to said counter means for sequentially producing driving signals on said n outputs thereof to sequentially drive said n drive lines of said display element array every time said counter means counts m clock pulses in said clock pulse signal.

2. A display device according to claim 1, further comprising:

brightness control means responsive to a brightness control signal for controlling the brightness of said display element array.

3. A display device according to claim 2, comprising:

said brightness control means arranged to disable said second driving means from driving said second drive lines of said display element array during the duration of said brightness control signal.

4. A display device comprising:

a unit display panel having M×N unit display devices arranged in a matrix form;

clock pulse supply means having M output lines for sequentially providing clock pulse trains, each having successive m clock pulses, to said M output lines thereof, said M output lines of said clock pulse supply means being coupled to M groups of said unit display devices, respectively, and each of said M groups having N unit display devices;

select signal supply means having N output lines for sequentially providing N select signals to said N output lines thereof, said N output lines of said select signal supply means being coupled to N groups of said unit display devices, respectively, and each of said N groups having M unit display devices;

a common source of serial pixel binary data; and each of said unit display devices including:

a display element array having first m drive lines, second n drive lines and m×n display elements arranged at intersections of said first m drive lines and said second n drive lines;

serial shift register means having a data input, a data output, and m×n stages for storing pixel binary data, said m×n stages divided into n blocks each having m stages, only a first block of said shift register means having m parallel outputs;

switch circuit means coupled to a corresponding output line of said select signal supply means and responsive to a select signal for selectively coupling one of said pixel data source and said data output of said shift register means to said data input of said shift register means;

first driving circuit means responsive to said m parallel outputs of said first block of said shift register means for driving said first m drive lines of said display element array; and second driving circuit means coupled to a corresponding output line of said clock pulse supply means and responsive to clock pulses for sequentially driving said second n drive lines of said display element array, comprising, counter means for counting said clock pulses from said clock pulse signal supply means, and decoder means having n outputs coupled to said n drive lines of said display element array and responsive to said counter means for sequentially producing driving signals on said n output thereof to sequentially drive said n drive lines of said display element array every time said counter means counts m clock pulses.

5. A display device according to claim 4, further comprising:

brightness control means responsive to a brightness control signal for controlling the brightness of said unit display devices.

* * * * *